United States Patent [19]

Pennerstorfer

[11] 4,194,251

[45] Mar. 25, 1980

[54] OVERFLOW VALVE

[76] Inventor: Walter Pennerstorfer, Dornbacherstrabe 93, A-1170 Wein, Austria

[21] Appl. No.: 887,247

[22] Filed: Mar. 16, 1978

[30] Foreign Application Priority Data

Mar. 31, 1977 [AT] Austria ..... 2260/77

[51] Int. Cl.[2] ..... E03C 1/232

[52] U.S. Cl. ..... 4/199

[58] Field of Search ..... 4/191, 195, 198, 199, 4/200, 201, 203, 206, 173 R, 187 R

[56] References Cited

U.S. PATENT DOCUMENTS

| | | | |
|---|---|---|---|
| 229,627 | 7/1880 | McFarland | 4/199 |
| 1,666,583 | 4/1928 | Rost | 4/198 |
| 1,980,493 | 11/1934 | Monsseau | 4/199 |
| 2,139,671 | 12/1938 | Corbin, Jr. | 4/195 |
| 3,835,484 | 9/1974 | Kato | 4/199 |

FOREIGN PATENT DOCUMENTS

| | | | |
|---|---|---|---|
| 46976 | 3/1911 | Austria | 4/199 |
| 36164 | 3/1965 | Fed. Rep. of Germany | 4/200 |
| 1191141 | 4/1959 | France | 4/199 |
| 385757 | 3/1965 | Switzerland | 4/200 |

*Primary Examiner*—Stuart S. Levy

*Attorney, Agent, or Firm*—Wender, Murase & White

[57] ABSTRACT

The present invention relates to an overflow valve provided with actuating means for a discharge valve, especially intended for bath-tubs. The actuating means are mounted in the bottom of a cup-shaped housing provided with apertures for the outlet of water, the actuating means being located recessed at least in the closed postion of the outlet valve.

4 Claims, 3 Drawing Figures

FIG. 1
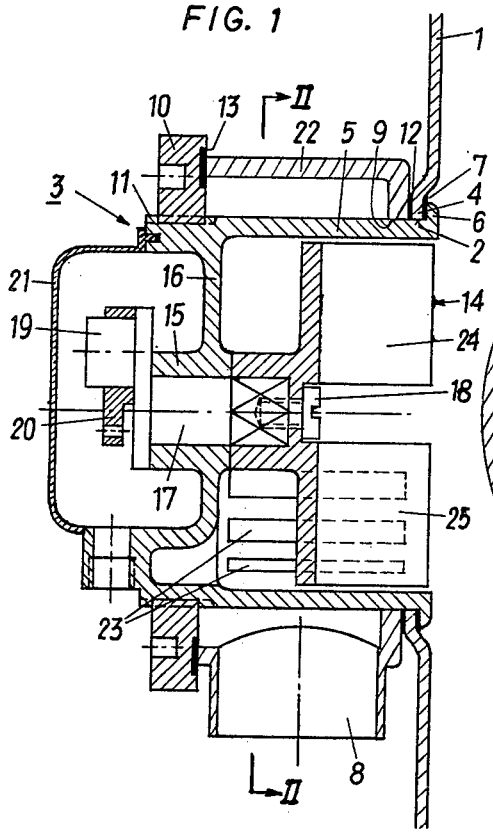
FIG. 2
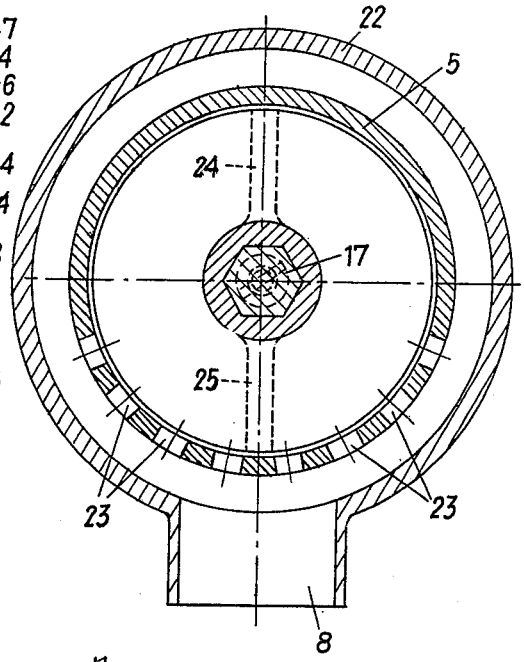
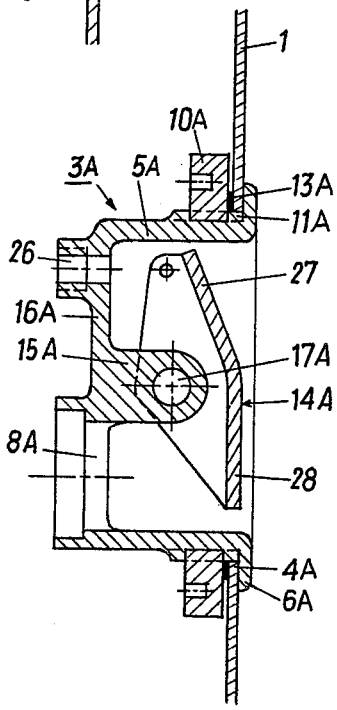
FIG. 3

OVERFLOW VALVE

BACKGROUND OF THE INVENTION

Present bath-tubs are known which have an overflow valve fitted with a rotary knob at the foot end, which knob via a cable or linkage located behind the bath wall actuates a discharge valve provided on the bottom surface of the bath. Known structures have the disadvantage that parts of the valve or its actuating members project inwardly from the wall of the bath and thereby make leaning against this wall uncomfortable to a user. There is, further, the requirement when bathing two children to sit them facing each other at opposite ends, each child being able to lean against one end wall of the tub.

SUMMARY OF THE INVENTION

According to the present invention there is provided an overflow valve with means for actuating an outlet valve, wherein the actuating means are mounted in the bottom of a cup-shaped housing provided with apertures for the outlet of water, the actuating means being located recessed at least in the closed position of the outlet valve.

The present invention contemplates use of either a rotary lever or a pressing or pivot lever for actuating the outlet system. The use of a pressing lever may involve a system known from ball point pens, in which initial depression of the lever closes the outlet valve, the same being opened by a further depression.

The present invention will be described further, by way of example, with reference to the accompanying drawings.

BRIEF DESCRIPTION OF THE DRAWINGS

FIG. 1 is an axial cross-section of a first embodiment of an overflow valve when installed;

FIG. 2 is a section taken on the line II—II of FIG. 1; and

FIG. 3 is an axial cross-section of a second embodiment of the overflow valve.

DESCRIPTION OF THE PREFERRED EMBODIMENTS

The numeral 1 denotes a wall of a bath tub, a wash basin or the like having a circular hole 2 in which an overflow valve 3, preferably made as a casting, is inserted. The edge 4 of the wall 1 surrounding the hole 2 is drawn in or provided with an impression and hence forms a hollow in which a cup-shaped housing 5 of the valve 3 is supported at its open end by means of an outwardly bent-over edge 6 with the interposition of a packing ring 7. In this form, the housing 5 on assembly of the valve 3 may be inserted from the inside of the bath tub into the hole 2. An outlet 8 is slid onto the housing 5 from the bottom surface thereon by its end-side opening 9 and retained thereon by a barrel nut 10 which is screwed onto a thread portion 11 provided on the cylindrical housing 5 and presses the forward end of the outlet 8 against the inside surface of the edge 4 with the interposition of a packing ring 12, and thereby retains the valve 3 in the installed position. A further packing ring 13 is provided between the barrel nut 10 and outlet 8.

To actuate an outlet valve, not shown, a control lever 14 is located recessed into the housing 5, which lever 14 is fixedly mounted on a shaft or pin 17 rotatably disposed in a boss or bearing 15 provided in the base 16 of the housing 5. The shaft 17 on its end remote from the lever 14 carries eccentrically a pin 19 on which a lever 20 for receiving a cable therein for operating the outlet valve, is rotatably mounted.

The eccentric mechanism is covered by a cap 21 which is secured to the housing 5 by screwing, plug-closure, cementing or the like.

The upper end of the outlet 8 mounted on the housing 5 has a outer housing 22 forming a chamber into which slots 23 formed in the lower part of the housing 5 lead.

For enabling actuation of the control lever 14 two diametrically arranged flanges 24, 25 are provided on the end face by means of which the control lever 14 may be displaced in either direction of rotation.

In one direction of rotation of the control lever 14, the eccentric pin 19 via a cable and lever, not shown, lifts the bottom valve for opening it, whilst in the other direction of rotation the eccentric pin 19 is lowered, causing the bottom valve to close under its own weight. The excess water is discharged through the slots 23.

The embodiment of the overflow valve according to FIG. 3 is space saving and can also be installed in existing bath tubs. Similar to that described above, this embodiment has a cup-shaped housing 5A, in which instead of the control lever 14 it has a double-armed rocking lever 14A mounted on a horizontal axis or pin 17A extending parallel to the wall 1 of the bath tub, which axis 17A is mounted in an extension or hearing 15A protruding from the bottom 16A of the housing 5A.

In the bottom 16A is provided an aperture 8A for connection of an outlet pipe for overflow water and an aperture 26 for the cable for actuating the bottom valve, which is connected to the end of one arm 27 of the rocker lever 14A located opposite the aperture.

The overflow valve 3A is secured to the wall 1 in a similar manner to that of the previous embodiment by means of a barrel nut 10A which is screwed onto the threaded portion 11A of the housing 5A and by interposition of packing 13A securely clamps the edge 4A of the aperture of the wall 1 between the barrel nut 10A and the outwardly bent edge 6A of the housing 5A.

In the embodiment of FIG. 3 a threaded portion is located on the open end of the housing 5A adjacent to the bent over edge 6A. It is necessary in this embodiment that with the bottom valve closed the arm 28 of rocker lever 14A is recessed into the housing 5A, so that e.g. it cannot press against the user leaning against the wall 1.

What we claim is:

1. An overflow valve for coupling to an outlet pipe for a bath-tub or like receptacle, comprising:

a cup-shaped housing having a bottom and provided with apertures in a lateral wall for outlet of water and having an outwardly bent-over edge whereby said housing may be mounted in an opening in a side wall of the receptacle with said edge against the inside of said wall and substantially flush thereto;

an outer housing surrounding said cup-shaped housing and having an outlet for coupling to the outlet pipe;

said cup-shaped housing being further provided on its circumference with a threaded portion to receive a barrel nut for holding said outer housing and said cup-shaped housing securely to the receptacle, and said apertures of said cup-shaped housing being disposed over the outlet of said outer housing for direct vertical drainage of liquid in said cup-shaped housing through said apertures and through said outer housing outlet into said outlet pipe; and means for actuating an outlet valve, said actuating means being mounted on the bottom of said cup-shaped housing and disposed over said apertures and, further, being recessed within the interior of said cup-shaped housing, said actuating means coupled to the outlet valve by a lift element means mounted on the bottom of the cup-shaped housing opposite from said actuating means.

2. An overflow valve as claimed in claim 1, in which the bottom of the cup-shaped housing is provided with a bearing part receiving a means for retaining said outlet valve actuating means for opening a bottom outlet valve.

3. An overflow valve as claimed in claim 2, in which said actuating means comprises a rotatable lever, said lever being fixedly mounted on a shaft provided with an eccentric pin for actuating a cable or the like.

4. An overflow valve as claimed in claim 1, in which a rocker lever is provided for actuating the outlet valve, one arm of said lever having said lift element means connected thereto.

* * * * *